US006181286B1

(12) United States Patent
Roscoe et al.

(10) Patent No.: US 6,181,286 B1
(45) Date of Patent: Jan. 30, 2001

(54) INTEGRATED SATELLITE/TERRESTRIAL ANTENNA

(75) Inventors: David Roscoe, Dunrobin; Philippe Lafleur, Ottawa; Brian Clarke, Kanata, all of (CA)

(73) Assignee: Vistar Telecommunications Inc., Ottawa (CA)

( * ) Notice: Under 35 U.S.C. 154(b), the term of this patent shall be extended for 0 days.

(21) Appl. No.: 09/358,446

(22) Filed: Jul. 22, 1999

Related U.S. Application Data

(60) Provisional application No. 60/093,675, filed on Jul. 22, 1998.

(51) Int. Cl.[7] ..... H01Q 21/00

(52) U.S. Cl. ..... 343/725; 343/895; 343/702

(58) Field of Search ..... 343/895, 725, 343/729, 702, 856, 857

(56) References Cited

U.S. PATENT DOCUMENTS

| | | | |
|---|---|---|---|
| 4,030,100 | 6/1977 | Perrotti | 343/709 |
| 4,959,657 | 9/1990 | Mochizuki | 343/725 |
| 5,317,327 | 5/1994 | Piole | 343/725 |
| 5,457,469 | 10/1995 | Diamond et al. | 343/730 |
| 5,479,178 | 12/1995 | Ha | 343/702 |
| 5,546,094 | 8/1996 | Egashira | 343/702 |
| 5,583,520 | 12/1996 | Thill | 343/702 |
| 5,600,341 | 2/1997 | Thill et al. | 343/895 |
| 5,610,620 | 3/1997 | Stites et al. | 343/725 |
| 5,650,792 | 7/1997 | Moore et al. | 343/725 |
| 5,684,672 | 11/1997 | Karidis et al. | 361/683 |
| 5,717,409 | 2/1998 | Garner et al. | 343/702 |
| 5,731,791 | 3/1998 | Jang | 343/702 |
| 5,812,097 | 9/1998 | Maldonado | 343/790 |
| 5,859,618 | 1/1999 | Miller, II et al. | 343/725 |

FOREIGN PATENT DOCUMENTS

| | | | | |
|---|---|---|---|---|
| 0747990 A1 | | 12/1996 | (EP) | H01Q/1/24 |
| 0755091 A1 | | 1/1997 | (EP) | H01Q/9/32 |
| 2206243 | | 12/1988 | (GB) | H01Q/5/00 |
| 2243724 | | 11/1991 | (GB) | H01Q/11/08 |
| 2246910 | | 2/1992 | (GB) | H01Q/11/08 |
| 2339969 | * | 2/2000 | (GB) . | |
| WO 97/41621 | | 11/1997 | (WO) | H01Q/5/00 |
| WO 98/15029 | | 4/1998 | (WO) | H01Q/1/36 |
| WO 99/28989 | | 6/1999 | (WO) | H01Q/5/00 |

* cited by examiner

*Primary Examiner*—Don Wong
*Assistant Examiner*—Ephrem Alemu
(74) *Attorney, Agent, or Firm*—Paul S. Sharpe; Marks & Clerk

(57) ABSTRACT

An integrated dual-mode antenna including a quadrifilar antenna and a collocated monopole antenna. The integrated antenna is compact and unencumbered by signal blockage or isolation problems.

13 Claims, 4 Drawing Sheets

INTEGRATED SATELLITE/TERRESTRIAL ANTENNA

This appln claims the benefit of U.S. Provisional No. 60/093,675 filed Jul. 22, 1998.

FIELD OF THE INVENTION

The present invention relates to an integrated antenna and more particularly, the present invention relates to a dual mode antenna system.

BACKGROUND OF THE INVENTION

In the prior art, satellite antennae, terrestrial antennae and integrations of these two have been proposed. Referring initially to the satellite antennae prior art, the quadrifilar helix has been known for several decades. This antenna includes four helical windings fed in phase quadrature. This arrangement provided several characteristics particularly well suited to satellite communications including a hemispherical omnidirectional radiation pattern with excellent circular polarization throughout the radiation pattern as well as compactness and structural simplicity.

For mobile terrestrial communications, the same omnidirectional requirement exists, but the radiation pattern need only to be omnidirectional at the horizon due to the constraints of terrestrial communications on the position of the user relative to base stations. The most common arrangement in the art is the monopole antenna comprising a simple wire above a ground plane.

More contemporary designs of antennae have included dual mode systems. These systems accommodate satellite and terrestrial antennae. These systems present significant design problems particularly with respect to isolation between the two antennae, signal blockage minimization and compactness.

The prior art systems attempted to alleviate the design difficulties by simply placing a satellite antenna and a terrestrial antenna a minimum distance apart such that isolation and blockage requirements were met. Although a generally useful concept, in order to achieve the most desirable performance, a significant separation between the antennae was required. This did not solve the problem of compactness and, in fact, compromised the compactness requirement.

In U.S. Pat. No. 5,600,341, issued Feb. 4, 1997, to Thill et al., there is provided a dual function antenna structure for transceiving in first and second modes.

The apparatus taught in this U.S. patent is a dual frequency single antenna as opposed to a dual mode dual antenna. Accordingly, in the Thill et al. disclosure, there is no teaching with respect to a co-location of two discrete antennae and accordingly, there is no recognition or discussion of the problems encountered when one attempts to co-locate two antennae. The structure provides two feed points for two fields but remains a dual frequency single antenna. This arrangement does not address whatsoever any of the complications inherent in co-location of two antennae such as caging of the signal from antenna to block communication of the co-located antenna.

Further prior art related to the present invention is set forth in U.S. Pat. No. 4,959,657, issued to Mochizuki, issued Sep. 25, 1990. This reference teaches an omnidirectional antenna having a reflector. There is no provision in this reference for the isolation of a monopole antenna with a quadrifilar antenna and accordingly, this reference simply teaches a variation on what is already known in this art.

Moore et al., in U.S. Pat. No. 5,657,792, issued Jul. 22, 1997, discloses a combination GPS and VHF antenna. The combination antenna provides a volute or quadrifilar antenna together with a monopole. Although the elements are provided, there is no co-location between the two antennae which, of course, does not contribute to the compactness of the antenna. By simply providing the combination of the two known antennae in spaced relation, interference problems are not in issue. From a review of the disclosure, it is clear that the Moore et al. reference fails to recognize the value of having a co-located antenna system.

The present invention completely overcomes the limitations in the known art and provides a dual mode antenna system having outstanding performance in a compact system.

SUMMARY OF THE INVENTION

One object of the present invention is to provide an improved dual mode antenna system.

A further object of the present invention is to provide an integrated antenna, comprising:

a quadrifilar antenna; and a monopole antenna positioned within the quadrifilar antenna and independent of said quadrifilar antenna.

Advantageously, the isolation difficulties inherent with prior art arrangements do not present any concerns in the instant system. In view of the fact that the monopole antenna has a field null in its center, interference or blockage of the monopole signal does not occur, thus allowing the antennae to function as if completely isolated. This feature facilitates collocation of the antennae without any loss in performance.

Another object of the present invention is to provide a method of forming a dual mode integrated antenna, comprising the steps of:

providing a quadrifilar antenna for transceiving circularly polarized fields;

providing a monopole antenna for transceiving linearly polarized fields;

co-locating the monopole antenna within the quadrifilar antenna and independent of the quadrifilar antenna; and phase coupling the monopole antenna to the quadrifilar antenna.

Having thus described the invention, reference will now be made to the accompanying drawings illustrating preferred embodiments.

BRIEF DESCRIPTION OF THE DRAWINGS

Similar numerals in the figures denote similar elements.

DETAILED DESCRIPTION OF THE PREFERRED EMBODIMENTS

Figure 1:
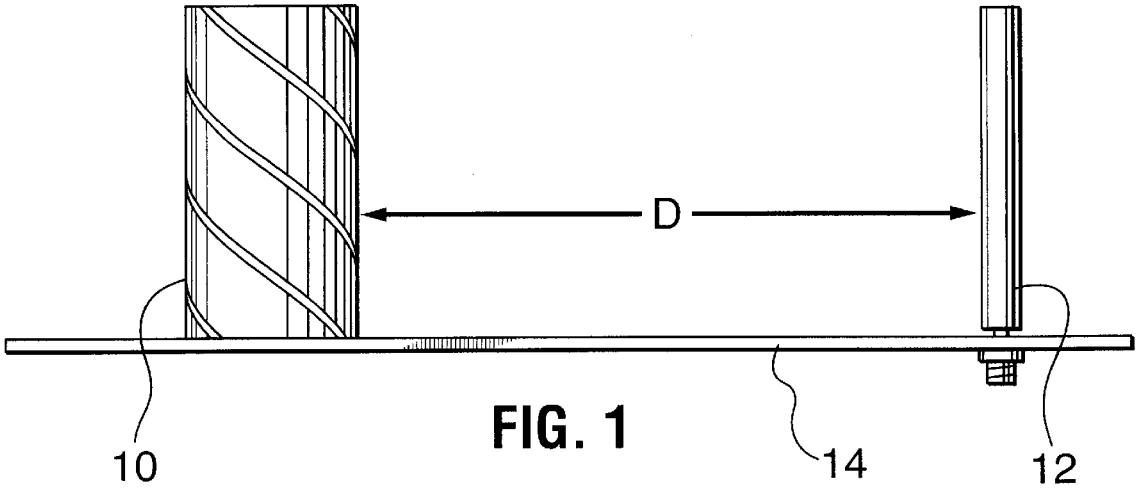
FIG. 1 is a schematic illustration of a dual mode antenna according to the prior art.

Referring now to the drawings, FIG. 1 illustrates a conventional dual mode antenna system having a cylindrical quadrifilar antenna 10 positioned in spaced relation to a monopole antenna 12. The antennae are mounted on a ground plane 14 and spaced by a distance D for purposes of isolation and signal blockage minimization.

Figure 2A:
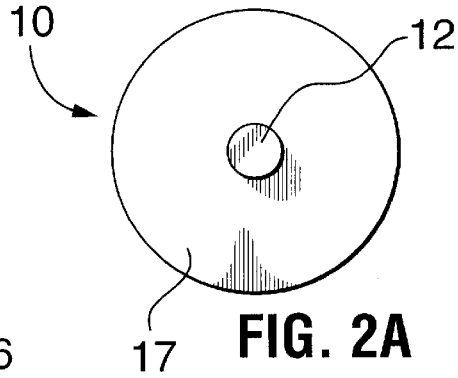
FIG. 2A is a cross-section of FIG. 2.
Figure 2:
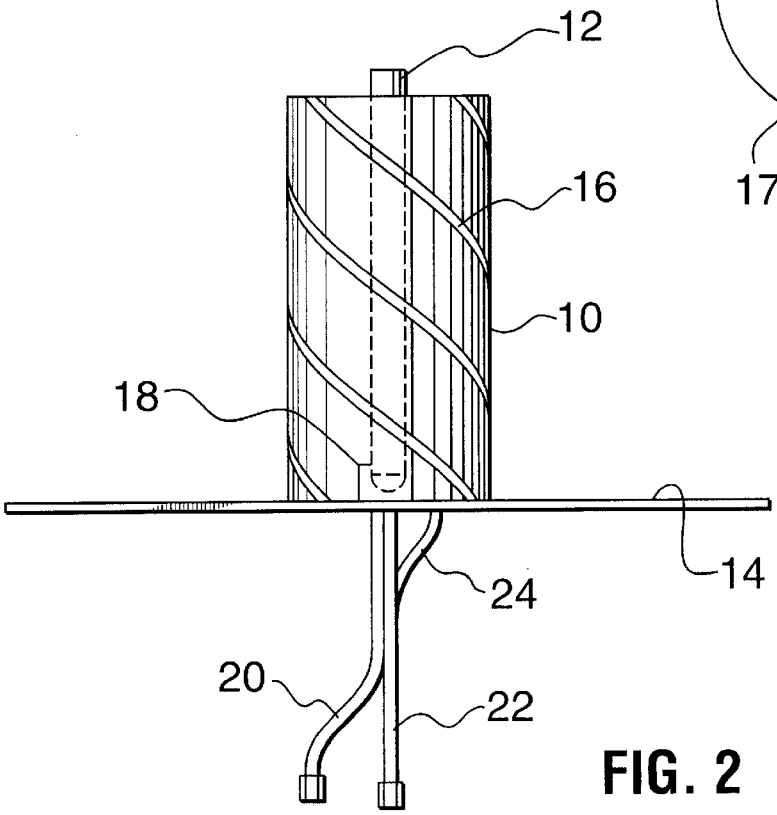
FIG. 2 is an elevational view of the antenna in accordance with one embodiment of the present invention.
Figure 3:
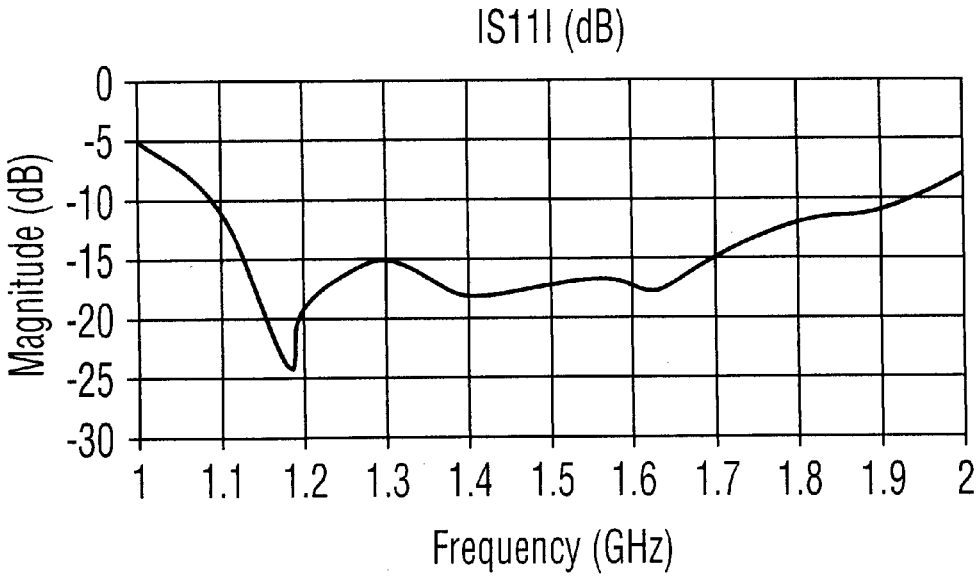
FIG. 3 is a graphical illustration of the return loss of the quadrifilar helix.
Figure 4:
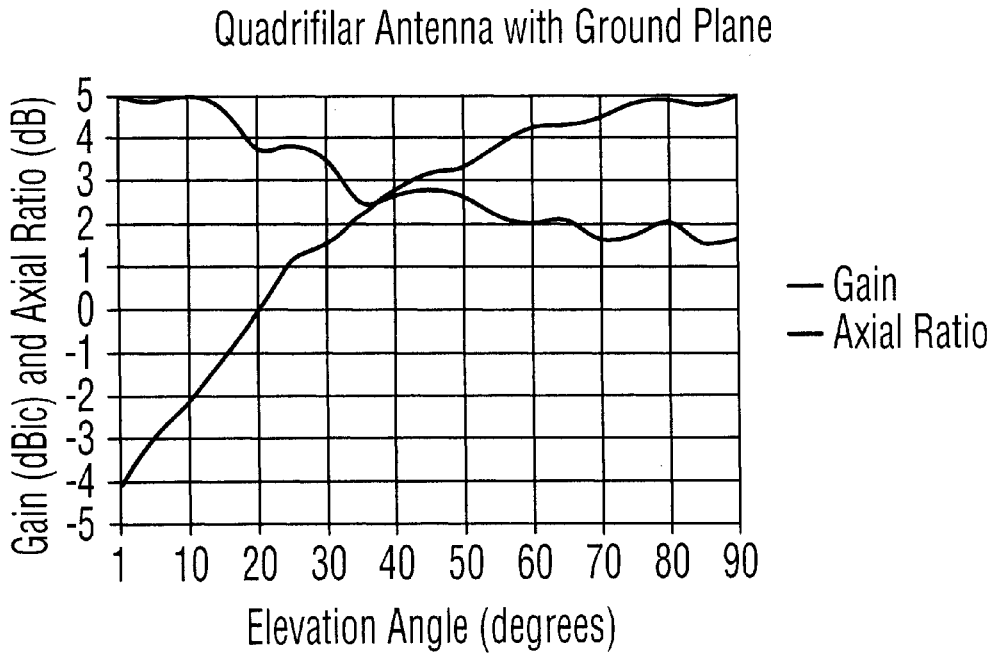
FIG. 4 is a graphical illustration of the radiation performance of the quadrifilar.
Figure 5:
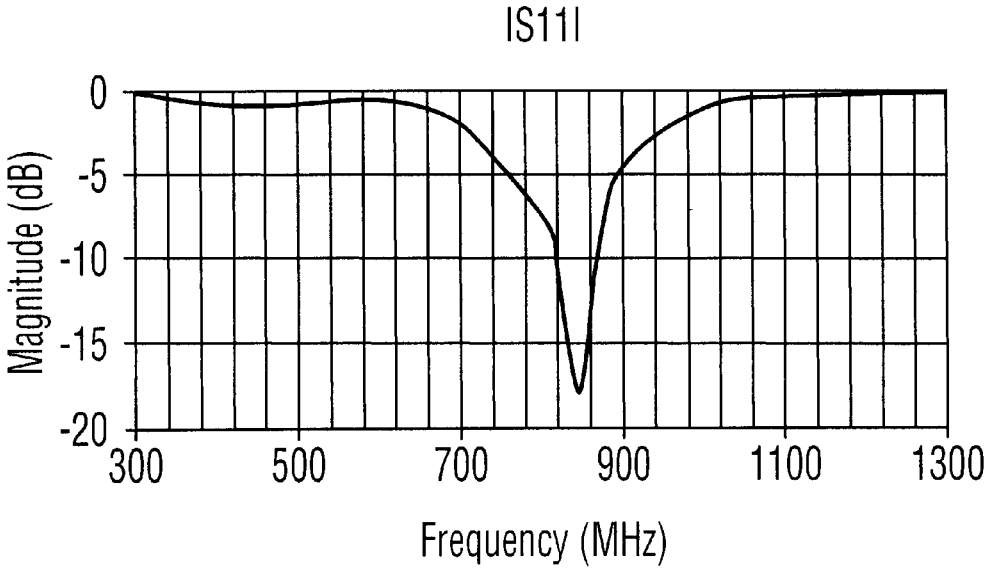
FIG. 5 is a graphical illustration of the return loss of the monopole.
Figure 6:
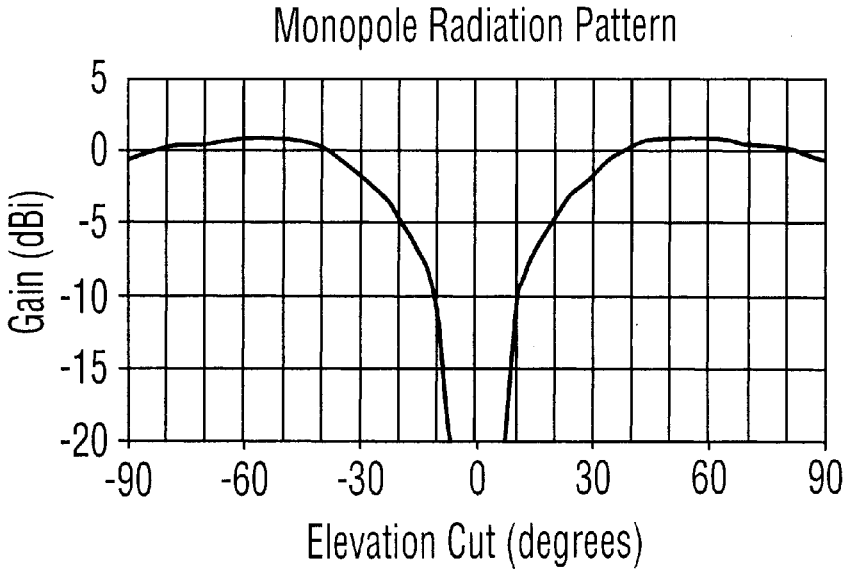
FIG. 6 is a graphical illustration of the elevation cut of the monopole.
Figure 7:
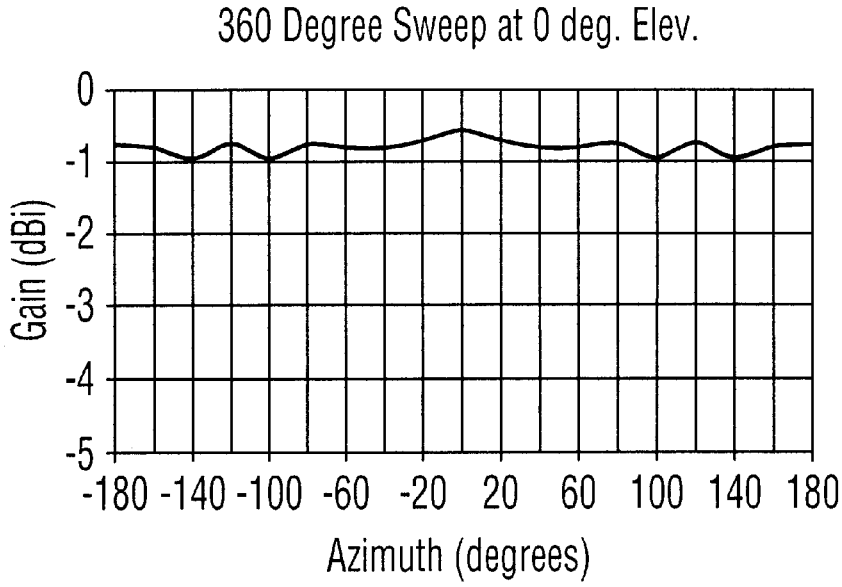
FIG. 7 is a graphical illustration of the azimuth sweep of the monopole.
Figure 8:
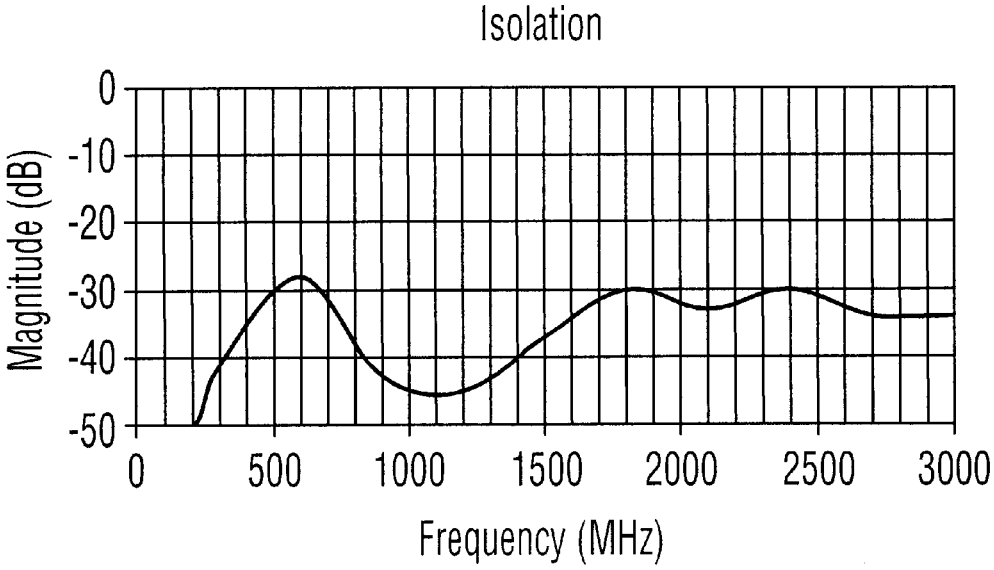
FIG. 8 is a graphical illustration of the frequency isolation between the two antenna ports.

FIG. 2 depicts an example of the antenna system according to one embodiment of the present invention. In the embodiment shown, the monopole antenna 12 is positioned centrally (coaxially) of the quadrifilar antenna 10. A capacitor and grounding tab, globally denoted by numeral 18, are provided. A connection 20 for the quadrifilar antenna is provided for connection with an external source (not shown). A similar connection 22 is provided for the monopole antenna 12. A brace 24 may be positioned beneath the ground plane 14 for bracing the system. The cylindrical quadrifilar does not demonstrate a field null in its center. The field pattern of the quadrifilar is formed by its windings 16. As mentioned herein previously, this significantly reduces the effect on performance with the presence of the monopole antenna 12. In the event that the frequency plan of the dual mode system is such that the satellite communications frequency is approximately an even multiple of the terrestrial communications frequency, the monopole antenna 12 presents a high impedance further improving the isolation between the two antennae 10 and 12.

In FIG. 2A, a cross-section of the antenna is shown in which a rigid foam material 17 is disposed between the quadrifilar antenna on its interior surface and the monopole antenna 12. As illustrated, the monopole antenna 12 is completely surrounded by the material 17. In instances where rigidity to the overall antenna unit is not required, then the rigid foam may be readily replaced with semi or non-rigid foam material. In terms of the material for the foam, suitable examples include polyurethane foam, polystyrene, polyvinyl chloride foam, inter alia. With respect to the quadrifilar antenna, as illustrated in FIG. 2, the antenna includes four windings, which windings present a 45° angle relative to the monopole. It has been found that a 45° disposition provides the most effective results, however, for winding dispositions in the range of 36° to 48°, adequate results are obtainable. The windings of the quadrifilar are mounted to a polymeric cylinder as illustrated in FIG. 2 and 2A, with the polymer being selected from any of the suitable polymers, examples of which include Kapton™, Mylar™, etc.

As is known, the quadrifilar antenna windings 16 can interfere or otherwise block a radiated pattern from the monopole antenna 12 to free space. The present invention has advantages in that this "caging" effect can be minimized. This is achieved by selectively positioning the windings 16 of the quadrifilar antenna 10. It has been found that this is an important feature in that if the angle of the windings is too steep, caging of the monopole antenna 12 will occur. Complications arise in the form of radiation pattern degradation as well as input impedance matching complications. If the pitch of the windings 16 is not steep enough, windings 16 become very close to each other and this results in the formation of an electrical wall which blocks radiation from the lower portion of the monopole antenna 12. It has been found that a winding pitch degree comprising 45° yielded outstanding results.

Due to coupling from the monopole antenna 12 to the windings 16 of the quadrifilar antenna 10 being in phase, the nature of the quadrature feed network if the quadrifilar antenna leads to phase cancellation of the coupled energy. This contributes to high isolation at the terrestrial operating frequency.

In the figures, the design frequencies were as follows:

Satellite RX:1525–1575.42 MHz

Satellite TX:1610–1660.5 MHz

Terrestrial RX:806–825 MHz

Terrestrial TX:851–870 MHz

FIGS. 3 through 8 demonstrate performance results for the present invention. These results were generated using the windings of the quadrifilar antenna at an angle of 45° as indicated herein.

Although embodiments of the invention have been described above, it is not limited thereto and it will be apparent to those skilled in the art that numerous modifications form part of the present invention insofar as they do not depart from the spirit, nature and scope of the claimed and described invention.

We claim:

1. An integrated dual mode antenna, comprising:

a quadrifilar antenna having a plurality of spaced apart windings and a feed connection for connection with a first feed; and a monopole antenna positioned within said quadrifilar antenna and independent of said quadrifilar antenna, said monopole antenna having a feed connection for connection with a second feed different from said first feed, said windings of said quadrifilar antenna being at an angle of between 36° to 48° relative to said monopole antenna.

2. The integrated antenna as set forth in claim 1, wherein said quadrifilar antenna includes four windings.

3. The integrated antenna as set forth in claim 1, wherein coupling from said monopole antenna to said quadrifilar antenna is in phase.

4. The integrated antenna as set forth in claim 1, wherein said windings are at a 45° angle relative to said monopole antenna.

5. The integrated antenna as set forth in claim 1, wherein said monopole is coaxially positioned within said quadrifilar antenna.

6. The integrated antenna as set forth in claim 1, wherein said windings of said quadrifilar antenna are mounted to a polymeric cylinder.

7. The integrated antenna as set forth in claim 1, wherein said quadrifilar antenna transceives circularly polarized fields and said monopole antenna transceives linearly polarized fields independently of said quadrifilar antenna.

8. The integrated antenna as set forth in claim 1, wherein said plurality of windings are equidistant.

9. The integrated antenna as set forth in claim 1, wherein a foamed polymer is positioned between said quadrifilar antenna and said monopole antenna.

10. The integrated antenna as set forth in claim 9, wherein said foamed polymer surrounds said monopole antenna.

11. A method of forming a dual mode integrated antenna, comprising the steps of:

providing a quadrifilar antenna for transceiving circularly polarized fields;

providing a monopole antenna for transceiving linearly polarized fields;

providing a separate feed connection for each of said guadrifilar antenna and said monopole antenna;

co-locating said monopole antenna within said quadrifilar antenna and independent of said quadrifilar antenna; and phase coupling said monopole antenna to said quadrifilar antenna.

12. The method as set forth in claim 11, further including the step of positioning a rigid polymeric foam material between said monopole antenna and said quadrifilar antenna.

13. The method as set forth in claim 12, wherein said polymeric foam completely surrounds said monopole antenna.

* * * * *